US006122866A

United States Patent [19]

Thomas et al.

[11] Patent Number: 6,122,866

[45] Date of Patent: Sep. 26, 2000

[54] METHOD AND APPARATUS FOR THE CONCEALMENT AND DISGUISEMENT OF ANTENNA STRUCTURES

[75] Inventors: Aubrey Trevor Thomas, Pretoria; Ivo Branislav Lazic, Midrand, both of South Africa

[73] Assignee: Brolaz Projects (PTY) Ltd., Midrand, South Africa

[21] Appl. No.: 08/803,400

[22] Filed: Feb. 20, 1997

[51] Int. Cl.[7] ..... E04H 12/02

[52] U.S. Cl. ..... 52/40; 52/726.3; 52/726.4; 52/736.1; 343/890; 343/891

[58] Field of Search ..... 52/40, 726.3, 726.4, 52/736.1, 736.2; 428/18; 313/901, 878; 343/890, 891

[56] References Cited

U.S. PATENT DOCUMENTS

| | | | |
|---|---|---|---|
| 3,144,375 | 8/1964 | Day | 52/40 X |
| 3,158,865 | 11/1964 | McCorkle . | |
| 5,015,510 | 5/1991 | Smith | 52/40 |
| 5,085,900 | 2/1992 | Hamlett . | |
| 5,171,615 | 12/1992 | Cohen et al. | 428/18 |
| 5,333,436 | 8/1994 | Noble | 52/726.3 |
| 5,581,958 | 12/1996 | Cote | 52/40 |
| 5,611,176 | 3/1997 | Juengert et al. | 52/40 |
| 5,787,649 | 8/1998 | Popowych et al. | 52/40 |

FOREIGN PATENT DOCUMENTS

| | | |
|---|---|---|
| 1549526 | 12/1968 | France . |
| 9516840 | 6/1995 | WIPO . |

OTHER PUBLICATIONS

Kosta, S. P., et al. "Television reception with papaya tree antenna." *Electronics & Wireless World*, vol. 90, No. 1582 (1984) pp. 25–29.

Kosta, S.P., "Television Receptiion With Papaya Tree Antenna", *Wireless World*, vol. 90, No. 1582, Jul. 1984, pp. 25, 29.

*Primary Examiner*—Carl D. Friedman
*Assistant Examiner*—Phi Dieu Tran A
*Attorney, Agent, or Firm*—Ladas & Parry

[57] ABSTRACT

A support structure is provided for supporting at least one antenna. The support structure includes a body portion, mounting means, an access passage, and artificial foliage. The body portion is anchored in use proximate its lower end to an anchoring surface and mounting means mounts the antenna proximate an operatively upper end of the body portion. The access passage extends at least partially between the upper and lower ends of the body portion. Artificial foliage is attached to the body portion and positioned so as to at least partially conceal the antenna. The artificial foliage typically resembles the fronds and leaves of a natural palm tree.

20 Claims, 11 Drawing Sheets

METHOD AND APPARATUS FOR THE CONCEALMENT AND DISGUISEMENT OF ANTENNA STRUCTURES

This invention relates to the concealment and disguisement of antennas. It relates in particular to a support structure for an antenna and to a method of at least partially concealing an antenna. It also relates to an artificial leaf component for the support structure.

According to the invention, there is provided a support structure for supporting at least one antenna, the support structure including a body portion which is anchored in use proximate its lower end to an anchoring surface;

mounting means for mounting the antenna proximate an operatively upper end of the body portion;

an access passage which extends at least partially between the upper and lower ends of the body portion; and artificial foliage attached to the body-portion and positioned so as at-least partially to conceal the antenna.

The access passage is typically used for maintenance and/or installation purposes. Accordingly, the base may have a lower door at its operatively lower end and an upper door at its operatively upper end, the lower and upper doors being connected by the access passage.

The base may be made of steel. Typically, a plurality of steel sections are serially attached to one another, e.g. by welding joints. In certain embodiments, the steel sections are stacked in a telescopic fashion with a friction fit.

The support structure may include a platform mounted at the upper end of the body portion, access to the platform being provided by the access passage. The platform is typically in the form of a service platform.

Further in accordance with the invention. there is provided a support structure for supporting at least one antenna, the support structure including a body portion which is anchored in use proximate its lower end to an anchoring surface and which is aesthetically configured to resemble a trunk of a palm tree;

mounting means for mounting the antenna proximate an Operatively upper and of the body portion; and artificial foliage which resembles the foliage of a palm tree, the artificial foliage being attached to the body portion and being positioned so as at least partially to conceal the antenna.

The support structure may include displaceable attachment means for displaceably attaching the artificial foliage and the mounting means to the body portion; and a displacement arrangement which co-operates with the displaceable attachment means to displace the artificial foliage and the mounting means between an operative position in which the artificial foliage and mounting means are proximate the upper end of the body portion, and an inoperative position in which the artificial foliage and mounting means are proximate the lower end of the body portion.

Typically, the support structure is in the form of a mast, such as those used, for example, in cellular telecommunication networks. However, the term "support structure" should be interpreted broadly to include any structure for supporting an antenna or the like. The term "support structure" thus includes structures which are not self-supporting such as those that are held in position by guy-ropes. The anchoring surface is typically the ground and the displacement arrangement is typically a winch, or the like.

For the purpose of this specification, the term artificial foliage should also be interpreted broadly to include any plant-like forms such as trees or the like. It should not be interpreted narrowly only to include leaf-like forms.

Accordingly, the artificial foliage may resemble branches and/or leaves of a tree. Preferably, the artificial foliage resembles leaf stems and fronds of a palm tree, such as fronds of a Cocos Plumosa, a Phoenix Reclinata, or the like. The artificial foliage may also be shaped to resemble a trunk of a tree.

The artificial foliage may include a plurality of elongate components, and a plurality of leaf-like formations attached to each elongate component. Typically, the leaf-like formations are moulded from a synthetic plastics material or the like.

The support structure may include attachment means for attaching the artificial foliage to the body portion. The attachment means may be configured to allow movement of the artificial foliage relative to the body portion. Typically, the elongated components may be releasably attached to the body portion.

The attachment means is typically in the form of a clamp configured to clamp onto the body portion. The clamp may have a plurality of mounting formations for mounting the elongate components to the clamp. In certain embodiments, the attachment means is in the form of-a socket in which an end of the elongate component is receivable. Typically, the end of the elongate component is potted by means of a rubberised material within the socket.

The elongate components and the leaf-like formations are typically made of a flexible resilient plastics material thereby to permit flexing of the elongate components and the leaf-like formations in a similar fashion to a natural tree.

Each elongate component may include a longitudinal passage, typically a central passage, which extends between its ends. Each elongate component may further include a flexible cord located in the passage to anchor, in the event of the elongate component being broken, a broken segment to the remainder of the elongate component.

The elongate components are advantageously made of a non-metallic material, such as reinforced fibre glass or the like, thereby to minimise interference with the antenna field.

Each elongate component may extend upwardly in use at an angle relative to the body portion. Accordingly, holding means may be provided to hold he elongate component at a preselected angle relative to the body portion. Typically, the holding means may be configured to hold different elongate components at different preselected angles. Each elongate component may be in cross-section trapezoidal, square, or of any other suitable shape.

Each elongate component and the leaf-like formations preferably resemble a frond of a palm tree.

The artificial leaves may comprise a plurality of leaf-like formations attached to a common spine. The leaf-like formations may extend transversely to the spine. The leaf-like formations may be arched when viewed in cross-section. The leaf-like components may also have zones of weakness intermediate their ends to permit the leaf-like formations to be bent at appropriate places during erection.

The artificial foliage may be arranged so that a plurality of elongate components extend upwardly relative to the body portion at a relatively small angle thereby to be positioned in close proximity to the antenna so as at least partially to conceal the antenna. Further elongate components may be arranged to extend operatively upwardly at a greater angle relative to the body portion.

The support structure may include concealment means for concealing attachment of the artificial foliage to the body portion. The concealment means may be in the form of a plurality of artificial palm tree husks.

The body portion may be composite in nature comprising a plurality of hollow frusto-conical sections serially connected. The body portion may include a base and a support frame. The base may resemble the trunk of a tree, e.g. the trunk of a Cocos Plumosa, and is typically painted and/or shaped accordingly. The support frame may be, mounted in use on top of the base and the antenna may be mounted on the support frame by the mounting means. Typically, three antennas are mounted on the support frame so that they face in angularly spaced radial directions.

The support structure may include a sleeve, or the like which is snugly located about the body portion and which is aesthetically configured to resemble the trunk of a natural palm tree.

The support structure may include a lightning conductor mounted on the upper end of the body portion and which extends in use above the antenna.

The support structure may include a navigation-warning light mounted proximate a terminal end of the support structure.

The invention extends to an artificial leaf component for a support structure as hereinbefore described, the artificial leaf component including a spine having attachment formation for attaching it to an elongate component of the support structure; and a plurality of leaf-like formations which are attached to the spine and which are aesthetically configured to resemble leaves of a palm tree.

In accordance with the invention a method of at least partially concealing an antenna structure includes locating a plurality of fronds of an artificial palm tree around at least a portion of the antenna at least partially to conceal the antenna.

The supporting structure may include a plurality of windshields for shielding the antenna from wind.

The invention is now described, by way of example, with reference to the accompanying diagrammatic drawings.

Figure 1:
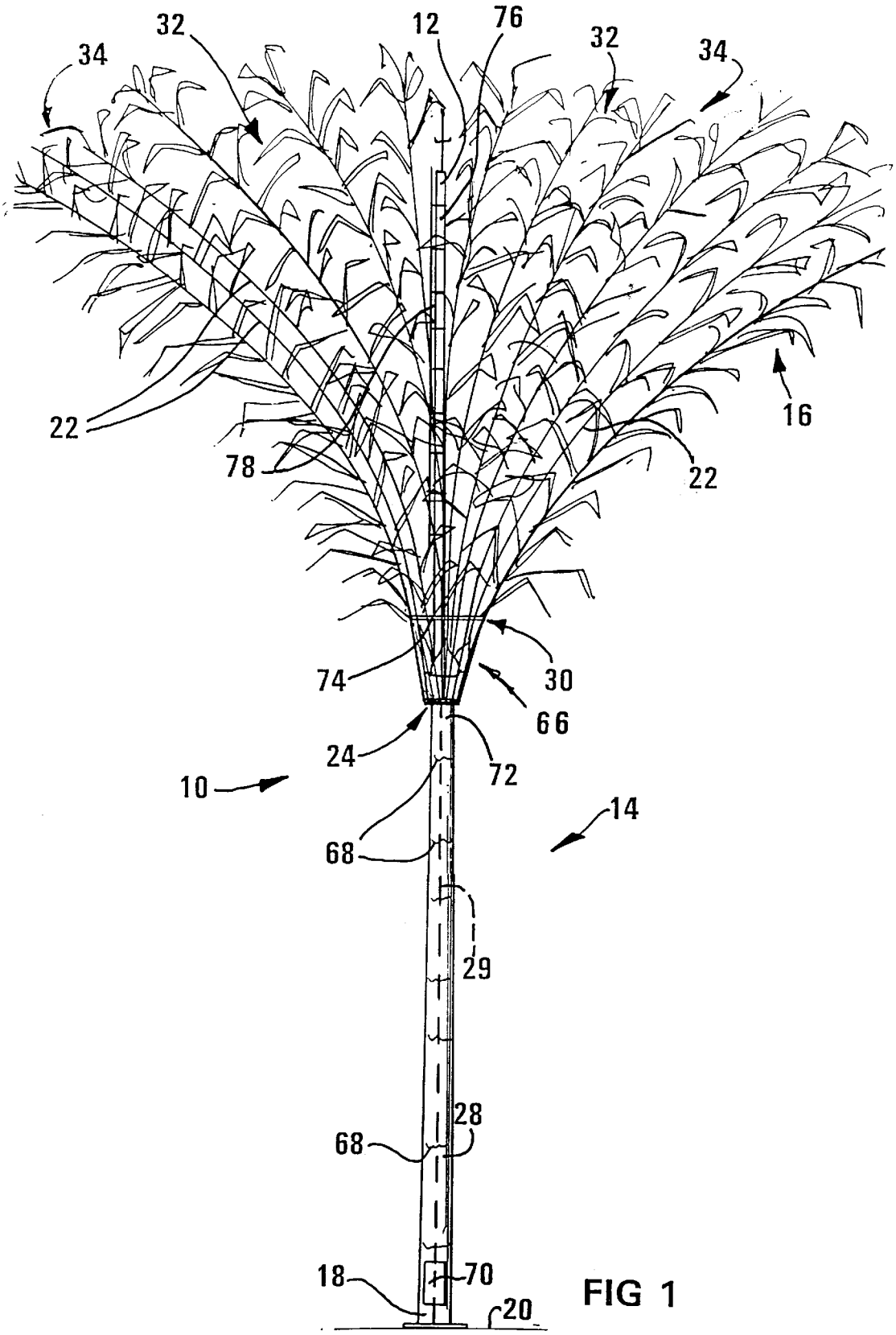
FIG. 1 shows a schematic side view of a support structure, in accordance with the invention, for supporting an antenna.
Figure 2:
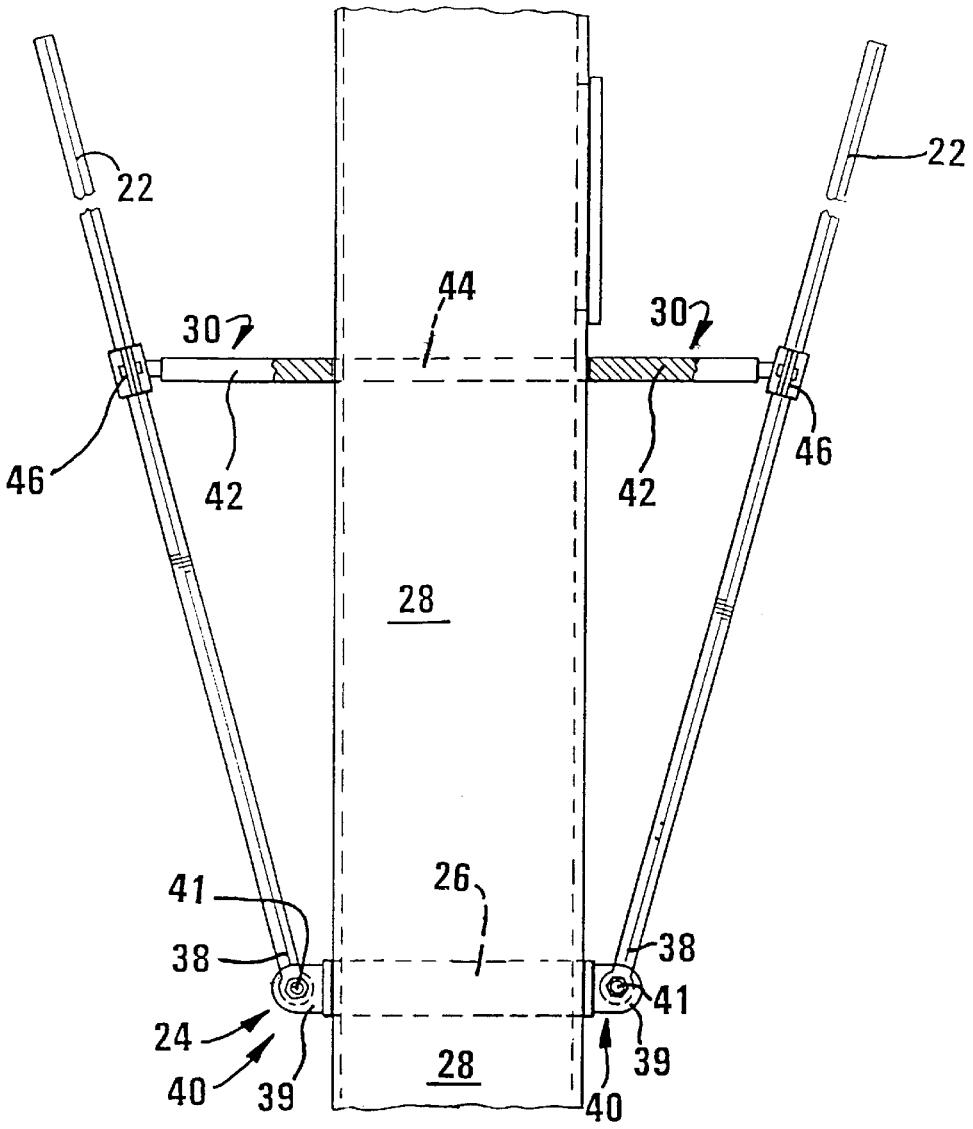
FIG. 2 shows a side view of a portion of the support structure to a larger scale showing attachment of two stems to a base of the structure.
Figure 3:
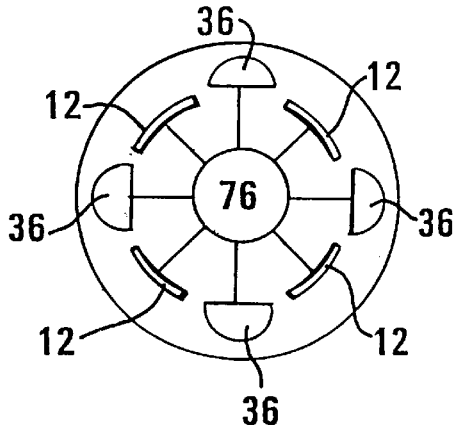
FIG. 3 shows a top view of the support structure, certain detail being omitted for clarity, and showing in, particular shields for shielding antennas from the stems.

In the drawings, reference numeral 10 generally indicates a support structure, in accordance with the invention, for supporting one or more antennas 12. The support structure 10 includes a body portion 14 (see FIG. 1) and artificial foliage 16 attached to the body portion 14 and positioned so as at least partially to conceal the antennas 12. The body portion 14 is anchored at its operatively lower end 18 to the ground 20. The support structure 10 is in the form of a mast and the antennas 12 are typically three cellular telecommunication network antennas.

The artificial foliage 16 resembles branches or stems, and leaves of a tree which, in the embodiment depicted in FIGS. 1 to 10 of the drawings, is in the form of a palm tree such as a Cocos Plumosa. Accordingly,. the artificial foliage 16 includes a plurality of elongate components which are in the form of branches or stems 22 which are attached at 24 (see FIGS. 1 and 2) by a clamp 26 to a base 28 of the body portion 14. Each stem 22 is flexible and resilient and is made of a non-metallic material, such as reinforced fibre glass or the like, thereby to minimise interference with the antenna fields of the antennas 12.

The stems 22 extend upwardly at an angle relative to the body portion 14 and holding struts 30 (see FIG. 2) are provided to hold them at different angles relative to the body portion 14 as is the case with fronds of a normal palm tree. Inner artificial foliage, generally indicated by reference numeral 32, is arranged to extend upwardly relative to the body portion 14 at a relatively small angle thereby to be positioned in close proximity to the antennas 12 so as at least partially to conceal the antennas 12. Outer artificial foliage, generally indicated by reference numeral 34, is arranged to extend operatively upwardly at a greater angle relative to the body portion 14 thereby to resemble outer or less vertically orientated fronds of a palm tree. The inner artificial foliage 32 may be secured to windshields 36 (see FIG. 3) to restrict their movement in the event of strong winds.

The clamp 26 has a plurality of mounting formations 40 (see FIG. 2) for mounting an operatively lower end 38 of each stem 22 to the clamp 26. Each mounting formation 40 comprises two spaced parallel plates 39 having apertures defined therein and the lower end 38 of each stem 22 has a transverse passage defined therein. The lower end 38 is located between the spaced plates 39 and secured in position by means of a nut and bolt arrangement 41. A number of holding struts 30 corresponding to the number of stems 22 are provided and each holding strut 30 has a spacing arm 42 which is mounted on the base 28 by means of a common bracket 44. A clamp 46, which is shaped and dimensioned to clamp onto the stem 22, is attached to an end of the arm 42 which is distal from its attachment to the bracket 44. The arms 42 have varying lengths so that stems 22 attached to different arms 42 are orientated at different angles relative to the base 28.

Each stem 22 has a central longitudinal passage 48 (see FIG. 5 and 6) which extends between its ends. A flexible cord 50 (see FIG. 6), such as a length of rope, is located in the passage 48 and is attached at its ends to opposed ends of the stem 22. Accordingly, in the event of the stem 22 being broken, a broken segment remains attached to the remaining portion of the stem 22 which is still attached to the base 28.

Figure 7:
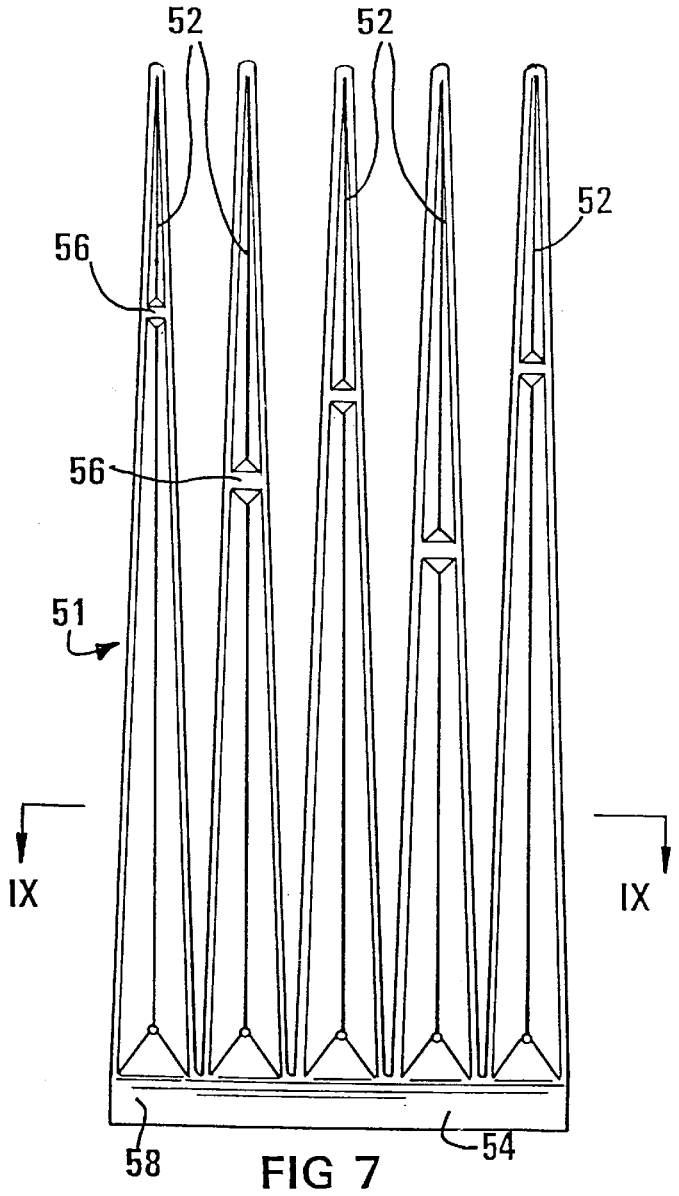
FIG. 7 shows a top plan view of a single artificial leaf component.
Figure 9:
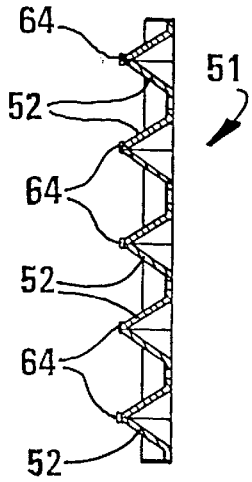
FIG. 9 shows a cross-sectional view of the leaf component of FIG. 7 taken at IX—IX.
Figure 8:
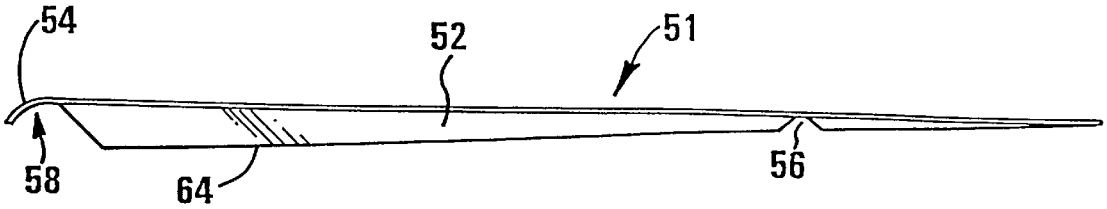
FIG. 8 shows a side view of the single artificial leaf component of FIG. 7.
Figure 10:
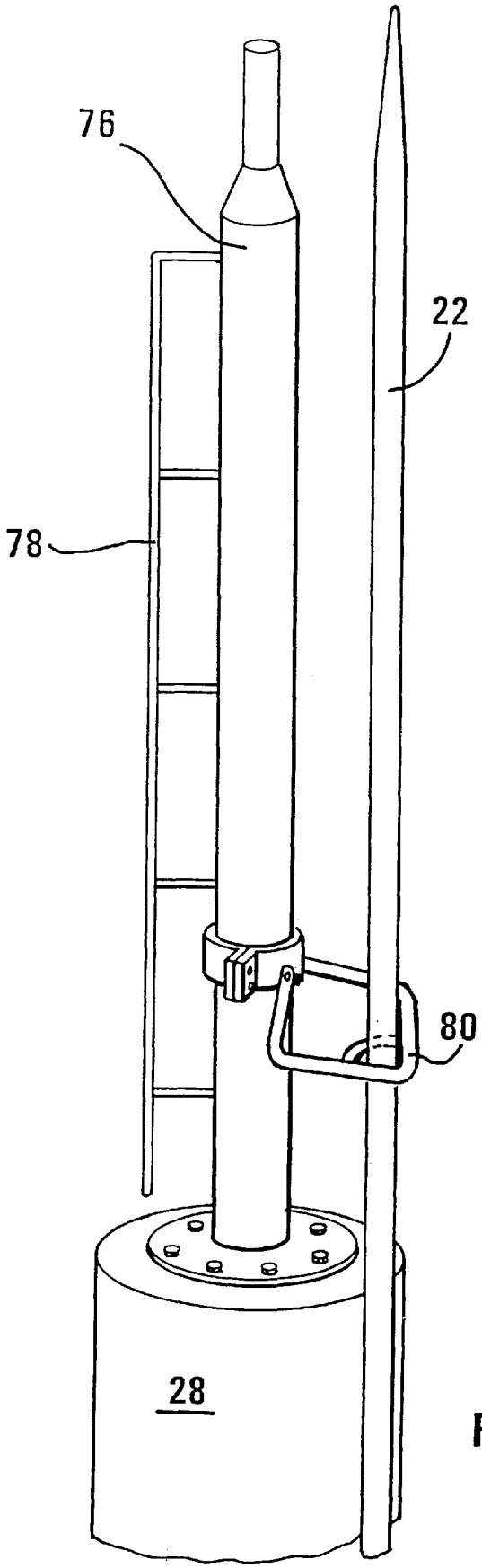
FIG. 10 shows a schematic three-dimensional view of a holding loop for holding inner artificial foliage in close proximity to the antennas.

The artificial foliage 16 includes a plurality of artificial leaf components 51 (see FIGS. 7 to 9). Each artificial leaf component 51 has a plurality of leaf-like members 52 attached to a common spine 54. The leaf-like members 52 extend transversely to the spine 54 and each leaf-like member 52 is triangular when viewed from an end (see FIG. 9). Zones of weakness or of reduced rigidity 56 (only a few of which are shown) are provided to encourage bending of the leaf-like members 52. The zones of weakness or of reduced rigidity 56 are located at different positions along a length. of each leaf-like member 52 so that they bend at different positions along their length thereby more closely to resemble leaves of a palm tree. The leaf-like members can thus be bent in a random fashion during erection of the structure.

The stem 22 is generally square in cross-section and, accordingly, the artificial leaf components 51 have matingly shaped mounting formations 58 (see FIGS. 6 and 8) to facilitate attachment thereof to the stem 22. Each shaped mounting formation 58 is defined by the spine 54 and is in the form of an angled bracket which operatively abuts a corner 60 (see FIG. 6) of the stem 22. A second mounting formation 58 of a further artificial leaf component 51, which extends in an opposite direction, fits snugly in overlapping relationship with the first mounting formation 58 and the two artificial leaf components 51 are then attached to the stem 22 by means of cable ties 62 (see FIG. 5). The artificial leaf components 51 are arranged so-that their upper ridges 64 face operatively upwardly as is the case with the leaves of a natural Cocos Plumosa palm tree.

The support structure 10 includes concealment means in the form of artificial husks 66 (see FIG. 4) which are positioned to conceal the lower ends 38 of the stems 22 and the clamp 26. The husks 66 are arranged in an overlapping fashion so as to resemble those of a natural palm tree.

The base 28 is shaped and coloured aesthetically to resemble a trunk of a normal palm tree (see FIG. 1). Accordingly, growth lines 68 (only a few of which are referenced) are provided on the base 28. The base 28 is typically 20 m in height and has a internal access passage 29, e.g. for maintenance purposes, extending between its ends. A lower door 70 is provided at-the lower end 18 of the body portion 14 and an internal step ladder (not shown) is provided between the lower end 18 and an upper end 72 of the base 28. An upper door (not shown) leads onto a platform 74 (see FIG. 1). The platform 74 is made of a non-metallic material thereby to reduce interference-with the antenna fields. The base 28 is formed from a plurality of steel sections which are serially attached to one another by means of welding joints.

The body portion 14 also has a support frame 76 (see FIGS. 1 and 10) which defines mounting means for mounting the antennas 12. The support frame 76 is mounted on top of the base 28 and a step ladder 78 is mounted thereon to facilitate access to the antennas 12. Typically, three antennas 12 are attached to the support frame 76 and the antennas 12 are positioned to face outwardly in angularly spaced radial directions.

The inner artificial foliage 32 is typically attached to the windshields 36 in order to hold their stems 22 in close proximity to the antennas 12. The windshields 36 also form protection means for protecting the antennas 12 from the artificial foliage 16 in the event of it being blown around in high wind.

The stems 22 of the inner foliage 32 are attached by holding means to the frame 76 (see FIG. 10) so as to be in close proximity to the antennas 12. The holding means are in the form of a plurality of angled holding loops 80 each of which encircles a stem 22 thereby allowing restricted movement of the stem 22. The holding loops 80 also prevent the stems 22 from being blown under windy conditions into contact with the antennas 12.

Referring to FIGS. 11 to 22 of the drawings, reference numerals 100 and 102 generally Indicate further embodiments of a support structure, in accordance with the invention, for supporting a plurality of antennas 12. The support structures 100, 102 resemble the support structure 10 and, accordingly, like reference numerals, have been used to indicate the same or similar features unless otherwise indicated.

Figure 11:
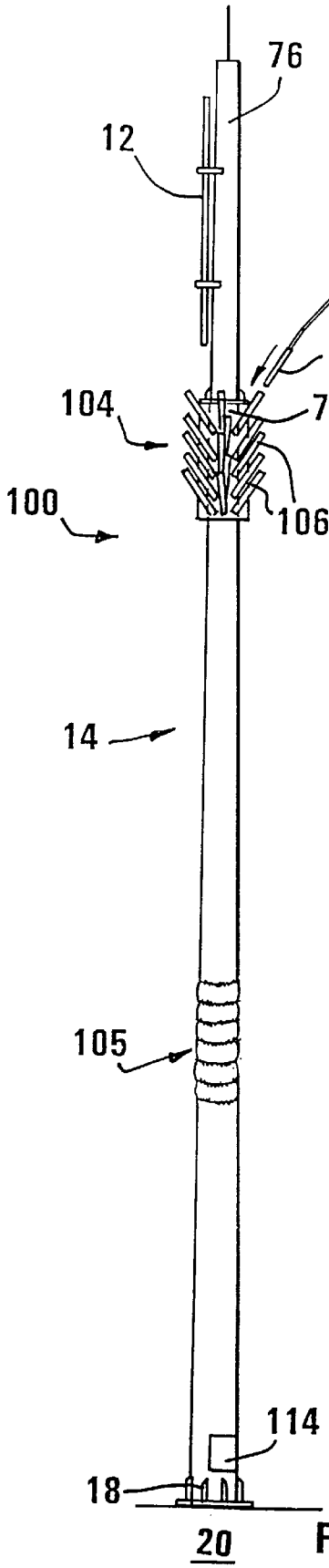
FIG. 11 shows a pictorial view of a further embodiment of the support structure, in accordance with the invention, for supporting an antenna.
Figure 12:
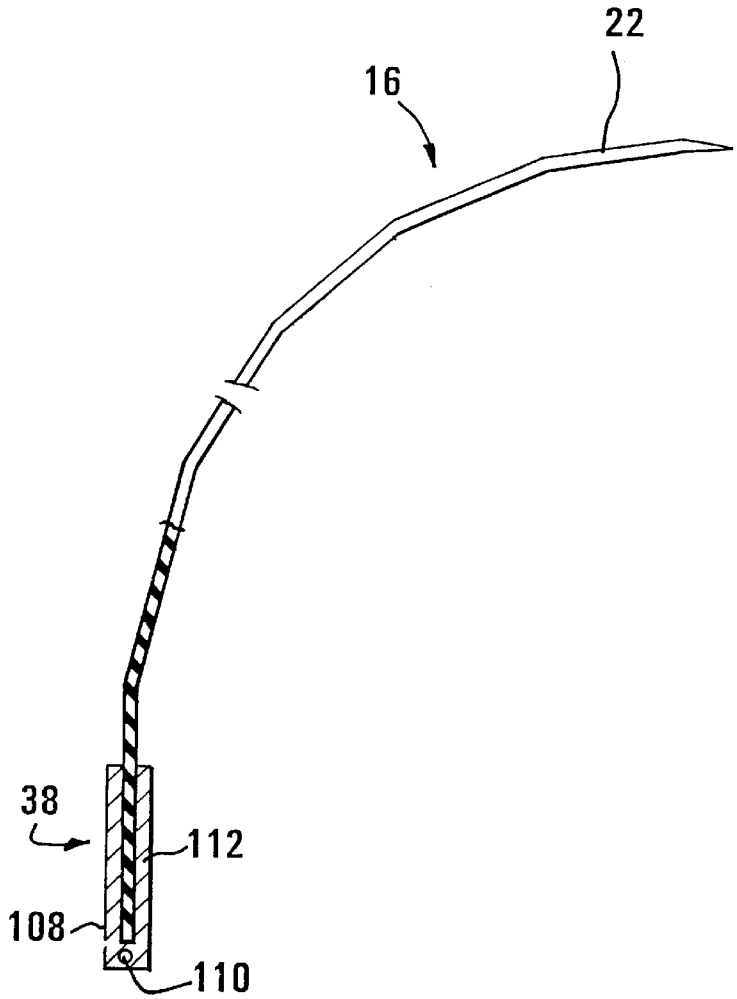
FIG. 12 shows an exploded view of a branch or stem of the support structure of FIG. 11.
Figure 13:
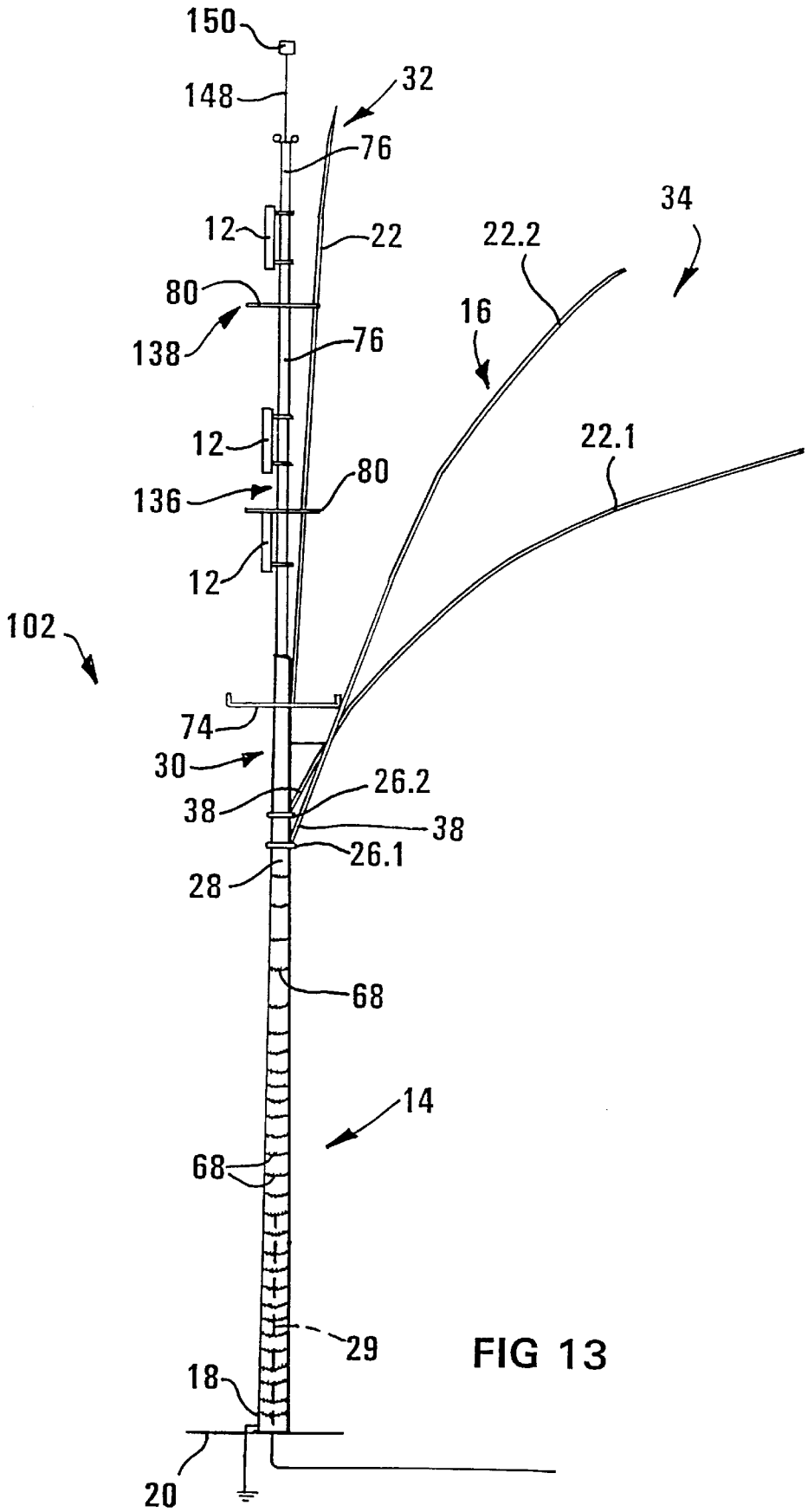
FIG. 13 shows a pictorial view of a yet further embodiment of the support structure in accordance with the invention.
Figure 14:
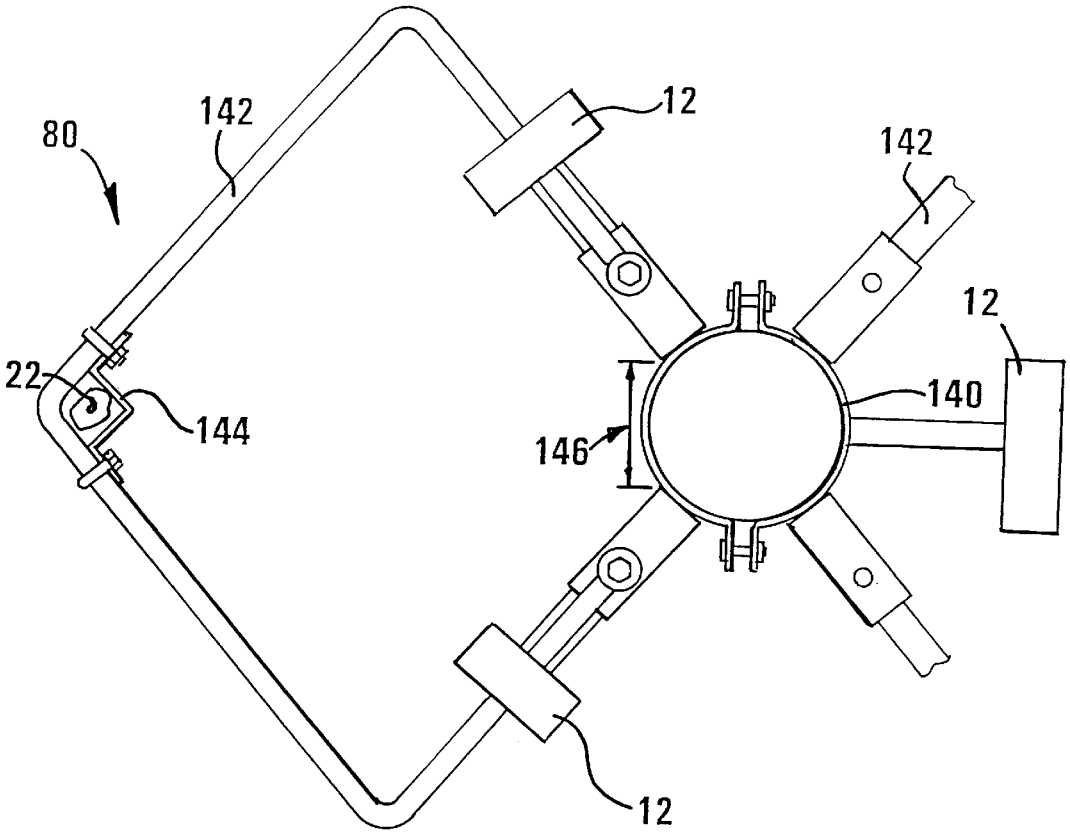
FIG. 14 shows a top plan-view of a holding loop and a mounting bracket of the support structure of FIG. 13.
Figure 15:
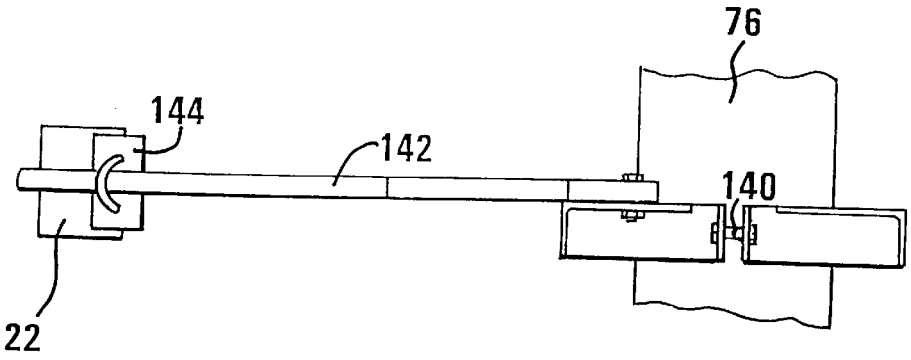
FIG. 15 shows a side view of the holding loop and the mounting bracket of FIG. 14.

Referring in particular to FIGS. 11 and 12 of the drawings, the support structure 100, as in the case of the support structure 10, includes a body portion 14 mounted at its lower end 18 to the ground 20. The support structure 100 also includes a support frame 76, which is mounted on an upper end 72 of the body portion 14, and which defines mounting>means for mounting an antenna 12. Unlike the support structure 10 which includes both a clamp 26 and holding struts 30 for supporting the stems 22, the support structure 100 includes only attachment means 104 for attaching an operatively lower end 38 of each stem 22, which is in the form of a frond, to the body portion 14. The attachment means comprises a plurality of square tub ular sockets 106 (only a few of which are referenced in the drawings for the purposes of clarity). The sockets 106 are orientated upwardly and obliquely relative to the body portion 14 and are arranged in such a fashion so that the stems 22 are orientated in a similar fashion to a conventional palm tree.

In each socket 106 a complemental square tubular plug 108 (see FIG. 12) is receivable. The square tubular plug 108 has an aperture 110 and each socket 106 has a corresponding aperture (not shown) to permit the plug 108 to, be bolted to the socket 106. The plug 108 is made of steel and includes an Internal passage in which the lower end 38 of the stem 22 is potted with a rubberised material 112 to permit movement between the lower end 38 and the socket 106. The stems 22 are typically made of a material such as HOSTALEN GM 9240 H T and are configured so that they resemble the flexibility of a frond of. a natural palm tree e.g. typically a Phoenix Reclinata palm tree. The support structure 100 is typically about 12 meters in height arid does not include an internal access passage as in the case of the support structure 10.

The attachment means 104 is a displaceable attachment means and a winch arrangement 114 is provided to permit displacement of both the support frame 76 and the attachment means 104 between an operative position (as shown in FIG. 11) in which the support frame 76 and the attachment means 104 are located proximate the upper end 72 of the body portion 14, and an inoperative position (not shown) in which the support frame 76 and the attachment means 104 is displaced to the lower end 18 of the body portion 14 thereby to facilitate maintenance of the antenna 12 and/or the artificial foliage 16. Typically, the body portion 14 includes a fibre glass sleeve 105 (only a portion of which is shown in FIG. 11) which is aesthetically configured to resemble the stem of the Phoenix Reclinata palm tree.

Referring in particular, to FIGS. 13 to 22 of the drawings, the support structure 102 resembles the support structure 10 of FIGS. 1 to 10, but has a different attachment arrangement for attaching the stems 22 to the body portion 14. In particular, the support structure 102 includes lower and upper clamps 26.1, 26.2 respectively (see FIGS. 13, 17 to 19). The upper clamp 26.2 defines attachment means for attaching operatively lower ends 38 of outer stems 22.1 of the outer artificial foliage 34 to the base 28 of the body portion 14. The lower clamp 26.1, which is located in a spaced relationship at an operatively lower position relative to the upper clamp 26.2, defines attachment means for attaching operatively lower ends 38 of inner stems 22.2 of the outer artificial foliage 34. Both the inner and the outer stems 22.2 and 22.1 respectively of the outer artificial foliage 34 have their movement restricted by holding struts 30, as will be described in more detail below. The inner and outer stems 22.2 and .22.1 are also typically made of a thermoplastics material such as HOSTALEN GM 9240 HT and are configured so that they resemble the fronds of a Cocos Plumosa palm tree.

Figure 18:
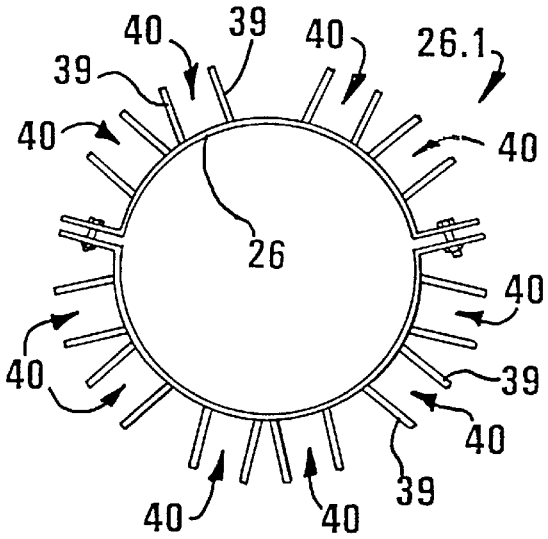
FIG. 18 shows a top plan view of a lower clamp of the support structure of FIG. 13.
Figure 19:
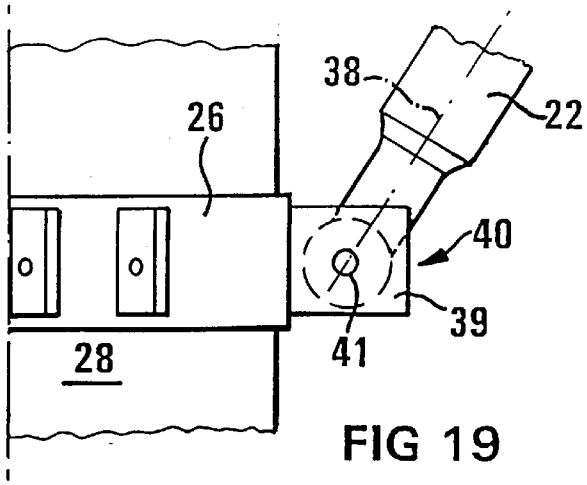
FIG. 19 shows a side view of attachment means for attaching a lower end of a stem to either the upper and the lower clamps of FIGS. 17 and 18.
Figure 20:
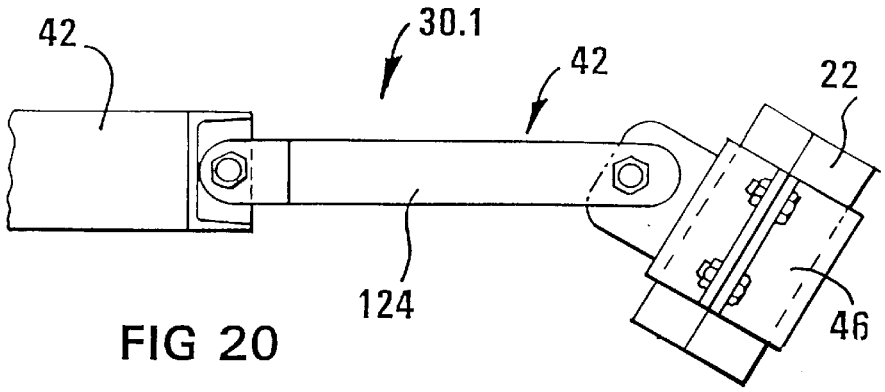
FIG. 20 shows a side view of a further embodiment of a holding strut used in the support structure of FIG. 13.
Figure 21:
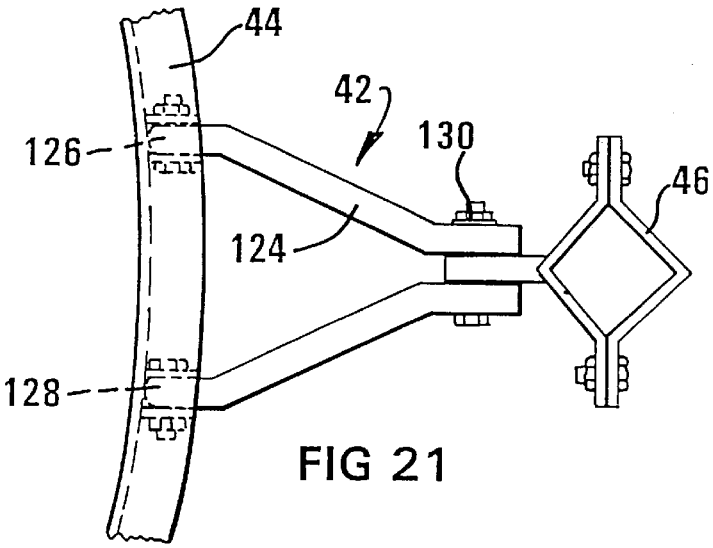
FIG. 21 shows a top plan view of the holding strut of FIG. 20.
Figure 22:
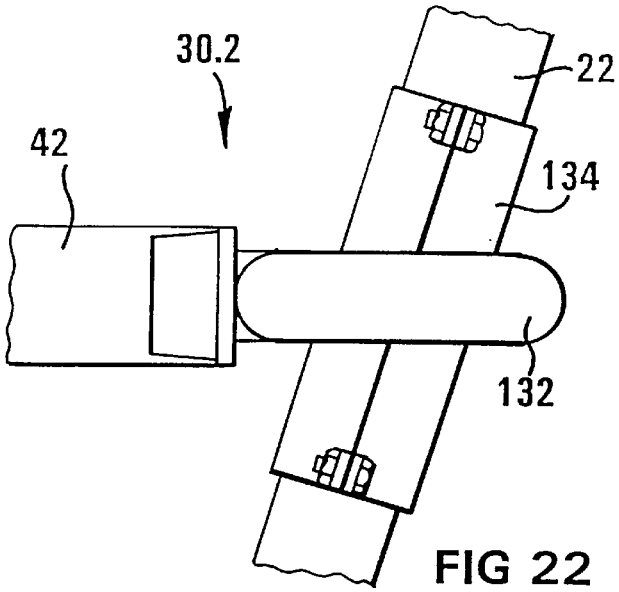
FIG. 22 shows a side view of a yet further embodiment of a holding strut used in the support structure of FIG. 13.

Typically, ten inner fronds or stems 22.2 are provided which have their operatively lower ends 38 attached to the lower clamp 26.1 by means of ten radially spaced mounting formations 40 (see FIG. 18). Likewise, the five outer fronds or stems 22.1 of the outer artificial foliage 34 have their operatively lower ends 38 mounted to the upper clamp 26.2 by five mounting formations 40 (see FIGS. 17 and 19). Each mounting formation 40 comprises two spaced parallel plates 39 (only a few of which are-referenced in FIGS. 17 and 18 for the sake of clarity) between which an apertured lower end 38 of each stem 22.1 or 22.2 is located, as the case may be. A nut and bolt arrangement 41, which passes through corresponding apertures in each plate 39 and the aperture provided in the lower end 38, fixedly attaches each stem 22.1 or 22.2 to an upper or lower clamp 26.2, 26. 1, respectively. The parallel plates 39 are attached to a common clamp 26 (see FIGS. 17 to 19) which, is clamped to the base 28 of the body portion 14. The upper and lower clamps 26.2 and 26.1 are clamped to the base 28-in such a fashion so that unhindered spaces 116 of the upper clamp 26.2 are aligned with the mounting formations 40 of the lower clamp 26.1 so that inner stems 22.2 extending therefrom are not hindered by outer stems 22.1 attached to the upper clamp 26.2.

Figure 16:
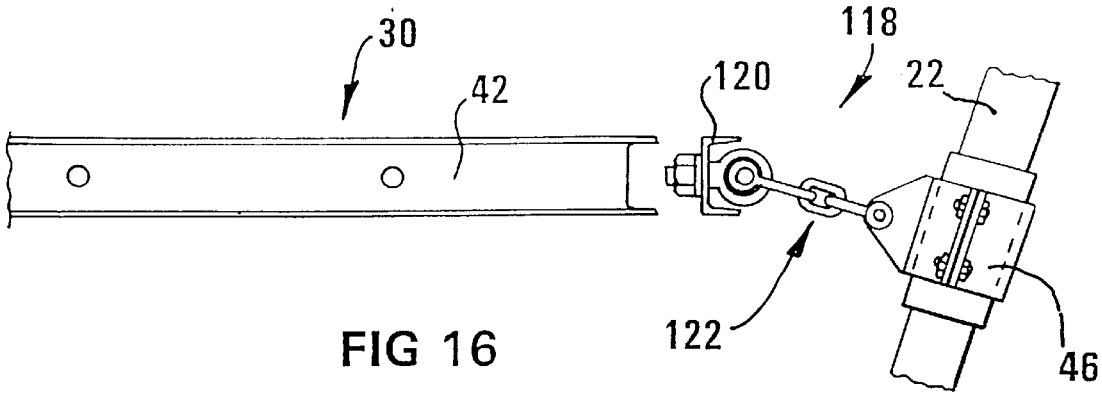
FIG. 16 shows a side view of a holding strut for holding a stem of the support structure of FIG. 13.
Figure 17:
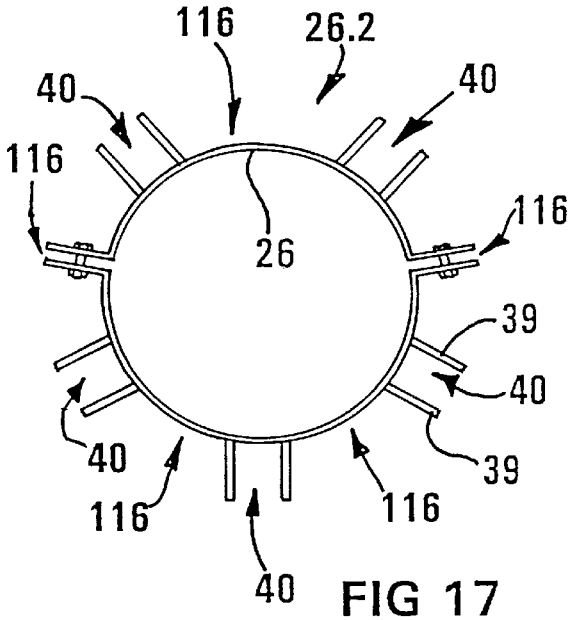
FIG. 17 shows a top plan view of an upper clamp of the support structure of FIG. 13.

Referring in particular to FIG. 16 of the drawings, the holding strut 30 includes a spacing arm 42 which is attached at its one end to a common bracket (not shown) and at its other end to a movable attachment means 118. The movable attachment means 118 comprises a clamp 46 which is clamped onto the stem 22, an anchor arrangement 120 which is anchored to the spacing arm 42, and a short chain link 122 which links the clamp 46 and the anchor arrangement 120. The anchor arrangement 120, with its chain link 122, permits movement of the stem 22 in all planes relative to the spacer arm 42 and thus allows the stem 22 to resemble the movement of a frond of a natural palm tree.

It is to be appreciated that the holding strut 30 may take on various forms to permit relative displacement between the stem 22 and the body portion 14. For example, in another embodiment of a holding strut 30.1 (depicted in FIGS. 20 and 22 of the drawings) includes a spacer arm 42 which is in the form of a wishbone arrangement 124. The wishbone arrangement 124 is pivoted at 126 and 128 to the common bracket 44, and at 130 to a clamp 46.

A further embodiment of the holding strut 30.2 (see FIG. 22) includes a spacing arm 42 to which a smooth metal ring 132 is attached. The ring 132 includes an inner lining of friction resistant material (not shown) and a further inner lining of a potted rubberised material (not shown) which defines a resilient clamping formation. A sleeve 134 is provided on that portion of the stem 22 that extends through the metal ring 132 to protect the stem 22.

Typically, four stems 22 which are attached to, the body portion 14 proximate the platform 74 define the inner artificial foliage 32. The stems 22 of the inner artificial foliage 32 are attached to the body portion 14 in a similar fashion to the stems 22 of the outer artificial foliage 34. The inner artificial foliage 32 is held in close proximity to the antennas 12 by holding means 80 (see FIGS. 13 to 15) which are positioned at upper and lower spaced locations 138, 136, respectively, of the support frame 76. A support means 80 is provided for each stem 22 and includes a bracket 140 (see FIG. 14 and 15) which is clamped onto the support frame 76. A generally square-shaped retaining ring 142 is attached to the bracket 140 and includes a retaining bracket 144 for checking movement of the stem 22. A step ladder 146 (see FIG. 14) extends from the platform 74 towards an uppermost end of the support frame 76 which terminates in an aviation warning light 148 (see FIG. 13) positioned at an uppermost end of a lightning conductor 150. A similar retaining ring 142 is attached to an opposed side of the bracket 142 and extends in an opposed direction to support a further stem 22 of the inner foliage 32. Three antennas 12 are mounted in a radially angularly spaced position an the support frame 76.

Figure 4:
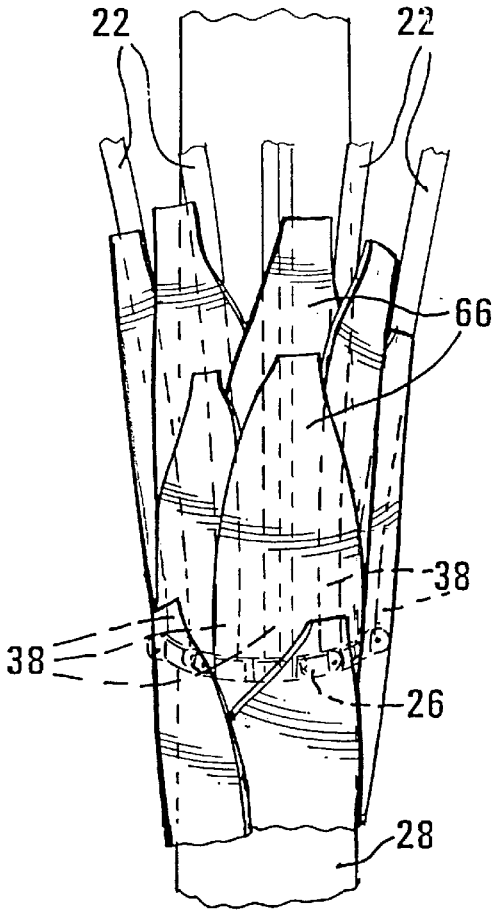
FIG. 4 shows a side view of a portion of the structure to a larger scale showing husks for concealing attachment of the stems to the base.
Figure 6:
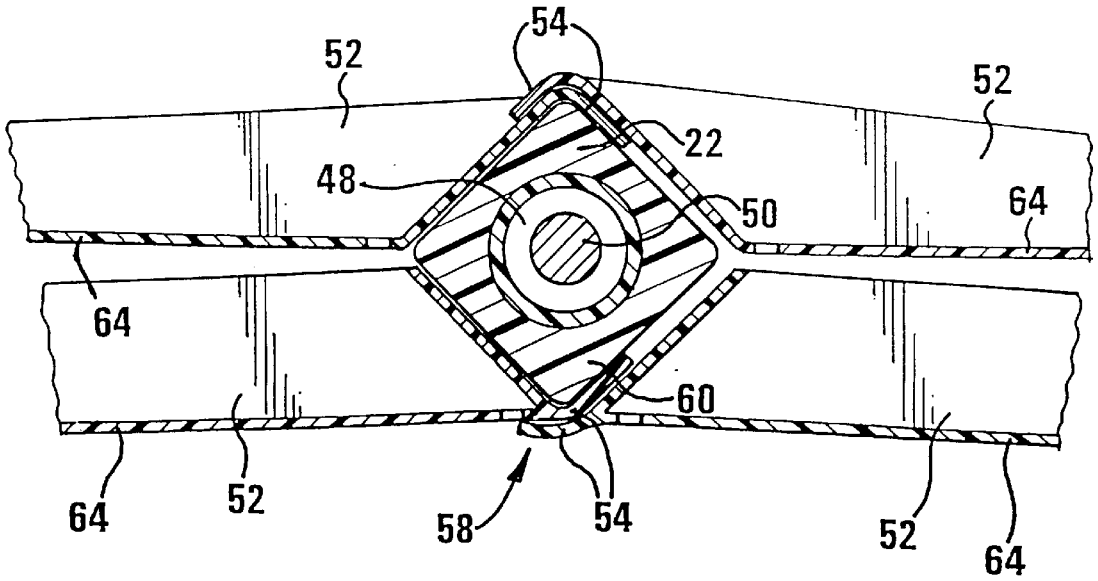
FIG. 6 shows a cross-sectional view of four artificial leaf components of FIG. 5 attached to a stem.
Figure 5:
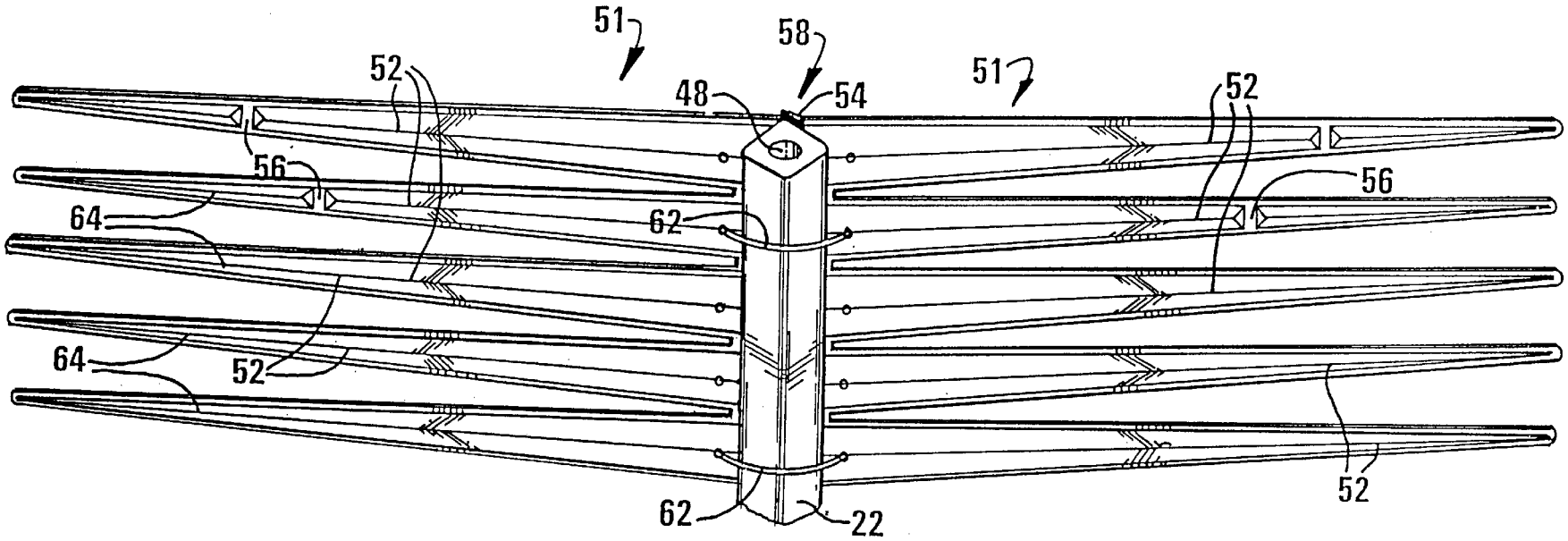
FIG. 5 shows a three-dimensional view of a portion of the structure showing artificial leaf components attached to a stem.

As in the case of the support structure 10, attachment of the operatively lower ends 38 of the stems 22 of the support structures 100, 102 are concealed by a plurality of husks 66 (see FIG. 4).

The invention, as illustrated, provides a support device 10, 100, 102 for supporting antennas 12 in such a fashion so that the antennas 1 2 may be at least partially concealed. What would normally be a conventional mast is thus disguised as a palm tree and the antennas 12 are at least partially concealed by the artificial foliage 16.

What is claimed is:

1. A support structure for supporting an antenna, the support structure including an elongate body portion having an upper longitudinal end and lower longitudinal end and which is anchored in use proximate its lower end to an anchoring surface;

mounting means provided at the upper longitudinal end of the body portion for mounting the antenna;

access means, comprising a hollow internal passage within the body portion which extends at least partially between the upper and lower ends of the body portion and having an internal diameter of sufficient magnitude to allow a person to pass through the passage, for allowing a person to gain access to the antenna from the internal passage;

artificial foliage attached to the body portion for at least partially concealing the antenna in use.

2. A support structure as claimed in claim 1, which includes a maintenance platform mounted at the upper end of the body portion, access to the platform being provided to maintenance personnel by the access passage.

3. A support structure as claimed in claim 2, which includes attachment means for attaching the artificial foliage to the body portion, the artificial foliage including a plurality of elongate components and a plurality of leaf-like formations attached to each elongate component and the attachment means being configured to allow movement of the artificial foliage relative to the body portion.

4. A support structure as claimed in claim 3, in which the elongate components and the leaf-like formations are made of a flexible resilient plastics material thereby to permit flexing of the elongate components and the leaf-like formations in a similar fashion to a natural tree.

5. A support structure as claimed in claim 3, in which each elongate component includes a longitudinal internal passage which extends between its ends, and a flexible cord located in the passage to anchor, in the event of the elongate component being broken, a broken segment to a remainder of the elongate component.

6. A support structure as claimed in claims 3, which includes holding means to hold each elongate component at a preselected angle relative to the body portion so as to define a generally clear zone in which the maintenance platform is located.

7. A support structure as claimed in claim 6, in which each elongate component and the leaf-like formations resemble a frond of a palm tree.

8. A support structure as claimed in claim 7, which includes a plurality of inner and outer fronds, the inner fronds extend upwardly relative to the body portion at a relatively small angle thereby to be positioned in close proximity to the antenna so as to at least partially conceal the antenna in use, and the outer fronds are arranged to extend operatively upwardly at a greater angle relative to the body portion.

9. A support structure as claimed in claim 1, which includes concealment means in the form of a plurality of artificial palm, tree husks for concealing attachment of the artificial foliage to the body portion.

10. A support structure as claimed in claim 1, in which the -body portion is composite in nature comprising a plurality of hollow frusto-conical sections serially connected.

11. A support structure as claimed in claim 1, which includes a lightning conductor mounted on the upper end of the body portion and which extends in use above the antenna.

12. A support structure as claimed in claim 1, which includes a navigation warning light mounted proximate an upper terminal end of the support structure.

13. A support structure for supporting an antenna, the support structure including an elongate body portion having a upper longitudinal end and a lower longitudinal end and which is anchored in use proximate its lower end to an anchoring surface, the body portion being aesthetically configured to resemble a trunk of a palm tree;

mounting means for mounting the antenna proximate the upper end of the body portion;

artificial foliage which resembles the foliage of a palm tree, the artificial foliage being attached to the body portion for at least partially concealing the antenna use;

displaceable attachment means for displaceably attaching the artificial foliage and the mounting means to the body portion; and a displacement arrangement which co-operates with the displaceable attachment means to displace the artificial foliage and the mounting means between an operative position in which the artificial foliage and mounting means are proximate the upper end of the body portion, and an inoperative position in which the artificial foliage and the mounting means as proximate the lower end of the body portion.

14. A support structure as claimed in claim 13, in which the- artificial foliage is made of a flexible resilient plastics material thereby to permit flexing of the foliage in a similar fashion to a natural tree.

15. A support structure as claimed in claim 13, which includes holding means to hold the artificial foliage at varying preselected angles relative to the body portion to at cast define a generally clear zone in which the mounting means are located.

16. A support structure as claimed in claim 15, in which the artificial foliage comprises a plurality of inner and outer fronds, the inner fronds extending upwardly relative to the body portion at a relatively small angle thereby to be positioned in close proximity to the antenna so as to at least partially conceal the antenna, and the outer fronds being arranged to extend operatively upwardly at a greater angle relative to the body portion.

17. A support structure as claimed in claims 13, which includes concealment means in the form of a plurality of artificial palm tree. husks for concealing attachment of the artificial foliage to the body portion.

18. A support structure as claimed in claim 13, which includes a sleeve which is snugly located about the body portion and which is aesthetically configured to resemble the trunk of a natural palm tree.

19. A support structure as claimed in claim 13, which includes a lightning conductor mounted on the upper end of the body portion and which extends in use above the antenna.

20. A support structure for supporting an antenna, the structure including an elongate body portion having an upper longitudinal end and a lower longitudinal end and which is anchored in use proximate its lower end to an anchoring surface, the body portion being aesthetically configured to resemble a trunk of a palm tree;

mounting means for mounting the antenna proximate the upper end of the body portion;

artificial foliage attached to the body portion, the artificial foliage resembling the foliage of a palm tree and being made of a flexible resilient plastics material thereby to permit flexing of the foliage to reduce its wind resistance in windy conditions;

attachment means for attaching the artificial foliage to the body portion, the artificial foliage including a plurality of elongate components and a plurality of leaf-like formations attached to each elongate component and the attachment means being configured to allow movement of the artificial foliage relative to the body portion;

each elongate component includes a longitudinal internal passage which extends between its ends, and a flexible cord located in the passage to anchor, in the event of the elongate component being broken, a broken segment to a remainder of the elongate segment.

* * * * *

UNITED STATES PATENT AND TRADEMARK OFFICE

CERTIFICATE OF CORRECTION

PATENT NO. : 6,122,866
DATED : September 26, 2000
INVENTOR(S) : Aubrey Trevor Thomas, et al.

It is certified that error appears in the above-identified patent and that said Letters Patent is hereby corrected as shown below:

Title page,
Insert -- [30] Foreign Application Priority Data Feb. 23, 1996 [ZA] South Africa..... 96/1483 --.

Signed and Sealed this

Eighteenth Day of September, 2001

*Attest:*

Nicholas P. Godici

NICHOLAS P. GODICI
*Acting Director of the United States Patent and Trademark Office*

*Attesting Officer*